United States Patent [19]

Cushman et al.

[11] Patent Number: 4,520,960

[45] Date of Patent: Jun. 4, 1985

[54] BARRIER-FREE WATER COOLER

[75] Inventors: Robert L. Cushman, Solon, Iowa; Arlan Koester, Rock City Ill.; Michael Eveland, Cedar Rapids, Iowa

[73] Assignee: Halsey Taylor Division of King-Seeley Thermos Co., Prospect Heights, Ill.

[21] Appl. No.: 457,729

[22] Filed: Jan. 13, 1983

[51] Int. Cl.[3] ..... E03B 9/20

[52] U.S. Cl. ..... 239/29; D7/304

[58] Field of Search ..... 62/389–395, 62/400; 137/637, 637.1; 239/24, 25, 28, 29, 29.5, 32; D7/304

[56] References Cited

U.S. PATENT DOCUMENTS

| | | | |
|---|---|---|---|
| D. 223,781 | 6/1972 | Wright | D7/304 |
| 2,841,799 | 7/1958 | Traynor | 239/29 |
| 2,865,182 | 12/1958 | Schultz | 239/29 |
| 2,914,252 | 11/1959 | Sorensen et al. | 239/29.5 |
| 3,734,408 | 5/1973 | Wright | 239/29 |
| 4,295,609 | 10/1981 | Brown, Jr. | 239/29 |

*Primary Examiner*—Jeffrey V. Nase

*Attorney, Agent, or Firm*—Harness, Dickey & Pierce

[57] ABSTRACT

A barrier-free water cooler construction as disclosed comprising an enclosure having a forwardly projecting cabinet section having a single basin on the upper side thereof and providing for access by handicapped persons. The invention includes a water dispensing system including a control valve mechanism which is operated by any one of three actuating push bars located on the front and laterally opposite sides of the enclosure. The water system includes a unique water precooling arrangement to reduce cooling energy requirements and may be provided with a glass or similar receptacle filler option which, like the aforesaid moveable actuating push bars, is adapted for motion-impaired or otherwise handicapped users.

8 Claims, 6 Drawing Figures

BARRIER-FREE WATER COOLER

BACKGROUND AND OBJECTS OF THE INVENTION

Barrier-free type water cooler apparatus, i.e., water coolers and fountains adapted for use by persons confined to wheelchairs and similarly handicapped persons, heretofore known and used have generally been categorized as electric or refrigerated type coolers, and non-electric, i.e., non-refrigerated type dispensers. Typical prior art designs include a basin or receptor constructed of a non-corrosive material and of a generally L-shaped configuration. When the device's water system is actuated, water not consumed by the user flows onto surfaces defined by the bottom leg of the "L" and through a drain hole and thereafter into the associated drain or waste system. The vertical leg of such prior art devices serves primarily as an extended splash-back and as the front cover to the cabinet directly therebehind. Such prior art cabinets generally have been constructed of painted sheet metal, stainless steel or sheet metal with a decorative material, such as a polymeric material bonded to the exterior surface, with the lower front portion of the cabinets generally housing the water dispensing mechanism, and the rear portions containing the unit's refrigeration system (if of the electric type) and supply lines to the dispensing valves and mechanism.

The aforementioned prior art type water cooler-fountains include a water dispensing system that utilizes side handles that when turned clockwise and/or counter-clockwise, transmit a force through an actuating rod or link assembly located in the lower cabinet interior to a valve (also located in the same area) which in turn effects the flow of drinking water.

Another prior art arrangement utilizes a front push-bar with a "rocker" type motion that when pressed at any point on the front surface, transmits a force directly to a push-button type valve/regulator to effect actuation of the water flow. This latter version may also include side push bars that are connected directly to the front push bar with small diameter, formed wires. When pressure is applied to either of the side push bars, the front push bar actuates the aforesaid water valve.

The dispensing mechanisms of prior art electrical water coolers-fountains heretofore known and used have included round push buttons that, when pressed, energize a push type switch mounted directly behind the button and the unit's front panel. The switch normally electrically energizes a solenoid-type valve and allows water to flow through the water system to the associated dispensing nozzle or bubbler. This latter type of device normally incorporates a time-delay feature to allow the solenoid valve to stay open after pressure to the push button is discontinued.

The prior art type water cooler-fountains of the aforedescribed character which have included glass filler features typically have the actuating button or lever located on the vertical surface of the basin, which requires that a force be applied by pushing in a horizontal plane. Other types of prior art arrangements which feature a glass filler substitute such a filler for the conventional bubbler and hence do not offer both the bubbler and the glass-fill option simultaneously. The aforesaid prior art water cooler-fountains have been found to be objectionable from the standpoint of serving handicapped persons, particularly those in wheelchairs, since they cannot meet the height clearance requirements now formally established in Federal Standards, A.N.S.I. 117.1-1980 and related federal guidelines now established through the Architectural and Transportation Barrier Compliance Board (A.T.B.C.B.). Moreover, the lower front cabinets of most of such prior art-type devices have been too low to allow convenient access by standard wheelchairs when the bubbler outlet is located in vertical compliance with either of the aforesaid statutory requirements.

Typical prior art devices shown in the patent literature are depicted in U.S. Pat. Nos. 4,081,134, 2,739,461 and 4,295,609; however, such prior art patents neither show nor suggest the features described hereinafter of the present invention, nor in any way anticipate the claims appended hereto.

It is accordingly a general object of the present invention to provide a new and improved water cooler-fountain of the type generally referred to above in the prior art, but which embodies a number of features not heretofore available nor suggested by such prior art arrangements.

It is a more particular object of the present invention to provide a new and improved water cooler and fountain which provides convenient access for all people, including those with motion and/or visual disabilities, so as to allow access by persons in wheelchairs and also meet the barrier requirements for safe access by the blind.

It is yet a more specific object of the present invention to provide a new and improved water cooler and fountain which may be electrically operated or non-electric, and which is adapted to be wall-hung, and which also conforms with requirements of applicable national disabled user statutes, particularly statutes applicable to users confined to wheelchairs and the like, such as A.N.S.I.-117.1-1980.

It is a further object of the present invention to provide a new and improved water cooler and fountain which is adapted for both new construction and retrofit applications.

It is another object of the present invention to provide a new and improved water cooler and fountain, which, by virtue of orientation of the refrigeration compressor closer to the floor than similar water coolers heretofore known and used, exhibits reduced noise characteristics.

It is still another object of the present invention to provide a new and improved water cooler and fountain which provides for improved head room characteristics as compared to similar type devices known in the prior art.

It is another object of the present invention to provide a new and improved water cooler and fountain which may be provided with a glass, cup or similar receptacle filler option for the benefit of handicapped persons who desire to use personal receptacles for obtaining water.

It is still another object of the present invention to provide a new and improved water cooler and fountain that may be provided with a front actuating bar and side actuating bars which may be installed as original equipment or may be retrofitted at a later date.

It is still another object of the present invention to provide a new and improved water cooler and fountain which features a unique water pre-cooler device, and which may be provided with a glass filler option having an improved actuating mechanism.

Other objects and advantages of the present invention will become apparent from the following description taken in conjunction with the accompanying drawings.

DETAILED DESCRIPTION OF THE PREFERRED EMBODIMENTS

Figure 1:
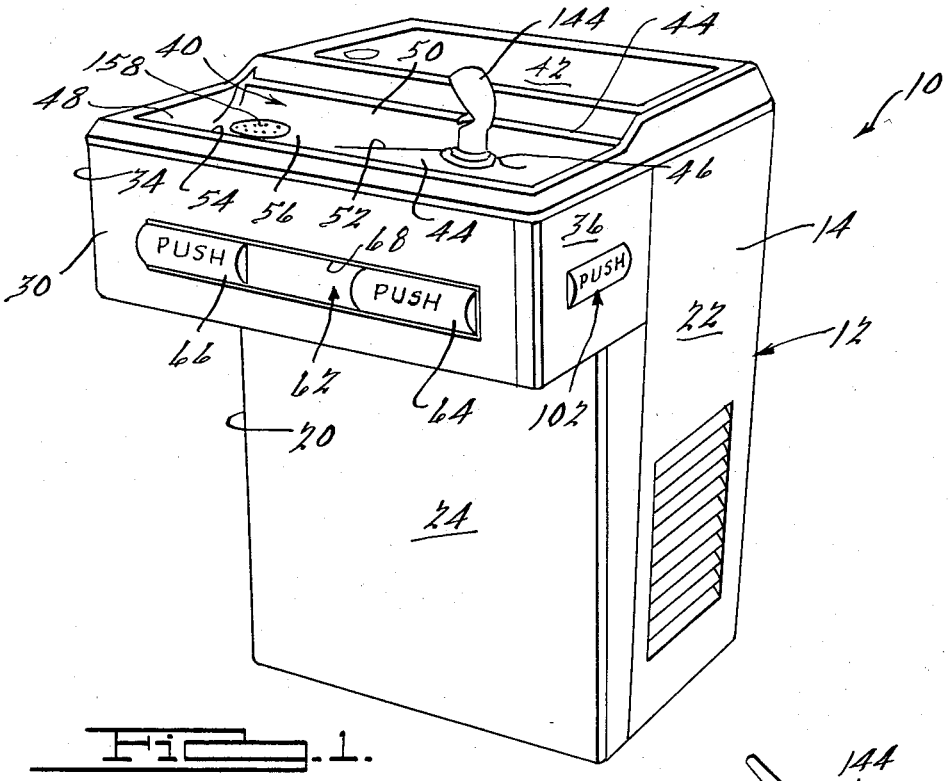
FIG. 1 is an elevated perspective view of the improved water cooler-fountain of the present invention.

Referring now in detail to the drawings and in particular to FIG. 1 thereof, a water-dispensing apparatus or water cooler-fountain, generally designated by the numeral 10, in accordance with one preferred embodiment of the present invention, is shown as comprising an external housing or cabinet 12 which is preferably fabricated of sheet metal, stainless steel, etc. having a suitable protective material on the exterior thereof. The cabinet or enclosure 12 comprises a rearward portion 14 including a back panel 16 adapted to be secured to an associated wall structure or the like, i.e., adapted to be wall hung, and a lower side or base panel 18 and left and right side panels 20 and 22, respectively. The forward side of the cabinet portion 14 comprises a front panel 24 which is removably mounted to provide access to the interior of the cabinet portion 14.

The cabinet or enclosure 12 also comprises a front or forward portion, generally designated by the numeral 30, which projects forwardly from the enclosure portion 14 and houses the water dispensing system of the apparatus 10. The enclosure portion 30 consists of a removable front panel 32 and removable left and right side panels 34 and 36, with the lower side of the cabinet portion 30 being enclosed by bottom panel 38. As shown in the drawings, the outwardly cantilevered cabinet portion 30 has an upwardly facing water basin or receptor, generally designated by the numeral 40, which is arranged slightly below the generally flat upper side of the rearward cabinet portion 14 that provides a countertop type surface, as seen at 42. An elevated back-splash surface 44 is disposed between the countertop 42 and the receptor 40 to assure that water flows toward the waste system of the apparatus 10. The receptor or basin 40 includes a bubbler mounting section 46 and a plurality of sloped or inclined surface portions 48, 50, 52 and 54 which are downwardly directed toward a drain area 56. Preferably, the basin or receptacle 40 is fabricated of a suitable stainless steel material or other suitable material having non-corrosive characteristics which may be conveniently cleaned to assure sanitary maintenance of the apparatus 10.

Figure 3:
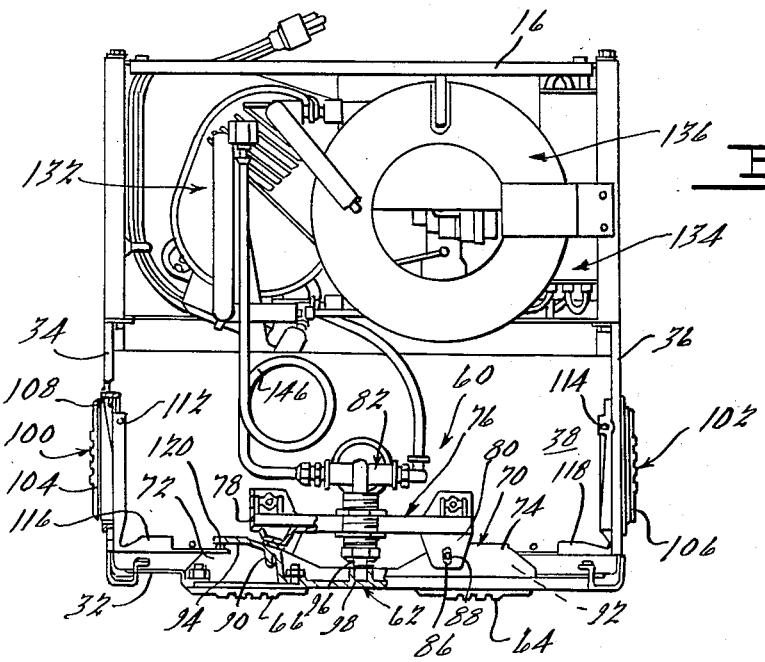
FIG. 3 is a top elevational view of the structure shown in FIG. 1 illustrating the water actuating bars and associated water circuit and refrigeration components.

The water dispensing apparatus 10 of the present invention comprises a water dispensing or actuating mechanism, generally designated by the numeral 60, comprising a front push or actuating bar 62 that is disposed in the front panel 32 of the forward cabinet portion 30 and includes a pair of laterally spaced apart manual engaging portions 64 and 66 which project outwardly from the forward side of the cabinet portion 30 through a generally horizontally-disposed elongated opening 68. The push bar 62 comprises a rearward mounting section 70, as best seen in FIG. 3, which includes laterally opposed mounting portions 72 and 74 and is adapted to be operatively secured to a valve mounting bracket, generally designated by the numeral 76, having horizontally opposed arm sections 78 and 80 and operatively supporting a water valve/regulator mechanism, generally designated by the numeral 82. More particularly, the push bar 62 is pivotably and slideably connected to the valve mounting bracket 76 by means of a pair of slots 86 which are formed in the arm sections 78, 80 thereof, which slots 86 slideably and pivotably receive pivot elements 88 that permit either end of the push bar 62 to mechanically pivot inwardly about the opposite of the elements 88 and slots 86, upon the application of manual pressure to said either end, and/or permits the entire push bar 62 to move inwardly upon the application of manual pressure generally centrally thereof, i.e., midway between the opposite ends thereof. Thus, when an inwardly directed manual pressure is applied to any portion of the push bar 62, the interconnection via the pivot elements 88 and slots 86 allows the push bar to pivot inwardly around the end thereof opposite that to which pressure is applied, or alternatively, slide directly inwardly when the pressure is applied at the center of the bar 62. The pivot element 88 may comprise cotter key-type elements or the like, spring pins or other type fastening means which provide for a loose but secure connecting relationship between the push bar 62 and the valve mounting bracket 76. It will be appreciated, of course, that the slots may be provided in the mounting portions 72, 74 instead of the valve mounting bracket 76 to obtain the same pivotable and sliding relationship hereinabove described without departing from the scope of the present invention. As best illustrated in FIG. 3, the mounting portions 72, 74 comprise internal cavities 90, 92 respectively, which define internal camming surfaces 94 intended to function in a manner hereinafter to be described.

The water valve/regulator mechanism 82 may be of any suitable construction known to those skilled in the art and comprises an actuating element 96 which is adapted to cooperate with the central portion 98 of the push bar 62 whereupon pivotal or inward movement of the push bar 62 will effect operation of the element 96 to effect opening of a flow path between a suitable source of potable water and the dispensing mechanism, i.e., bubbler, provided upon the receptor 40, as later to be described.

Figure 2:
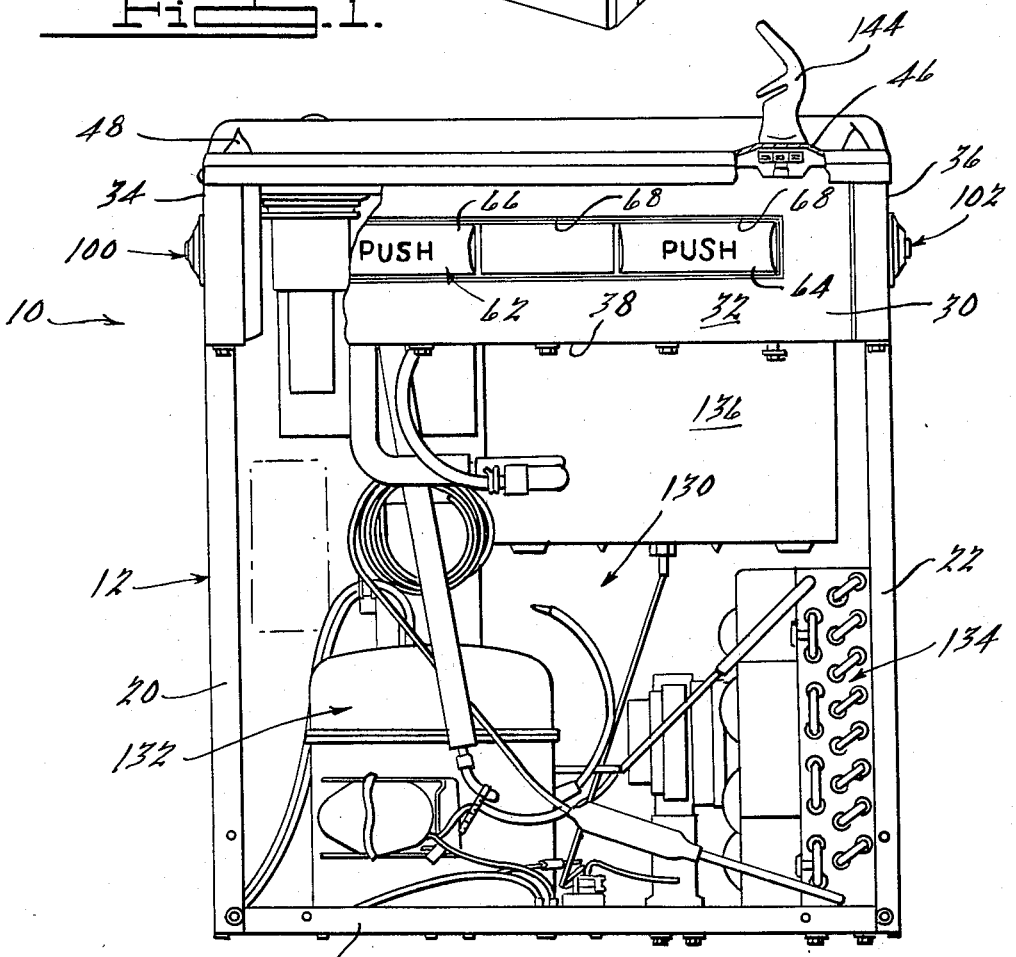
FIG. 2 is a front elevational view of the present invention with the access panel for the rearward cabinet portion thereof removed so as to show the refrigeration components embodied in the cooler fountain of the present invention.

In accordance with the present invention, in addition to actuation of the water valve/regulator mechanism 82 via the front push bar 62, water may also be dispensed by applying pressure to either or both of a pair of side push bars 100, 102 which are mounted on the left and right sides 34 and 36 of the front cabinet portion 30, as best seen in FIGS. 1, 2 and 3. The side push bars 100, 102 include manual engaging portions 104 and 106 respectively, which project outwardly from the side panels 34, 36 through suitable openings 108. The side push bars 100, 102 are intended to be pivotably mounted via suitable pivot pins 112 and 114 so that they may be pivotable about respective vertical axes. The push bars 100, 102 comprise laterally inwardly-extending actuating leg portions 116 and 118 respectively, having engagement surfaces 120 adapted for operative engagement with the surfaces 94 in the opposite ends of the front push bar 62, as best seen in FIG. 3. The interrelationship between the surfaces 94 and 120 is such that when either side push bar 100 or 102 is depressed, a sliding force is transmitted to the adjacent end of the front push bar 62 via the actuating leg portions 116, 118, resulting in said adjacent end of the front push bar being biased pivoted about the opposite end thereof to effect actuation of the element 98 of the water valve/regulator mechanism 82 in the manner hereinabove described.

A unique feature of the present invention resides in the fact that with the components above described, the side push bars 100, 102 may be provided as original equipment on the apparatus 10 or may be added at some later date, i.e., retrofitted, without requiring any major reconstruction of the apparatus 10. More particularly, since the side push bars 100, 102 are not permanently joined to the front push bar 62, but instead, merely transmit a motion by sliding contact between the surfaces 94 and 120, the side push bars 100, 102 may be provided in the form of a retrofit kit that can be easily attached to the apparatus 10 without affecting mounting or dismounting of the front push bar 62 or any other parts of the overall water-dispensing mechanism of the apparatus 10.

As previously mentioned, the water dispensing apparatus 10 of the present invention may be of the refrigerated, i.e., electrical, or non-refrigerated, i.e., non-electrical type, with the arrangement shown in the drawings being of the former variety. Toward this end, the apparatus 10 is provided with a refrigeration system, generally designated by the numeral 130, which is disposed within the rearward portion 14 of the enclosure 12. As best seen in FIGS. 2 and 3, the refrigeration system 130 comprises a conventional hermetically sealed compressor 132, a forced draft condenser assembly 134 and an insulated evaporator/chiller assembly 136. As will be appreciated by those skilled in the art, the compressor 132, condenser 134 and evaporator/chiller 136 are operatively connected through conventional refrigerant conduits such that gaseous refrigerant at relatively high pressure is supplied by the compressor 132 to the condenser 134, the refrigerant being cooled and liquified as it passes through the condenser 134. The thus-cooled and liquified refrigerant flows from the condenser 134 to the evaporator/chiller assembly 136, where the refrigerant is vaporized by the transfer of heat thereto from water which is circulated through the chiller portion (later to be described) of the assembly 136, resulting in cooling of the water. The gaseous refrigerant then flows from the assembly 136 back to the inlet or suction side of the compressor 132 for recycling.

Figure 4:
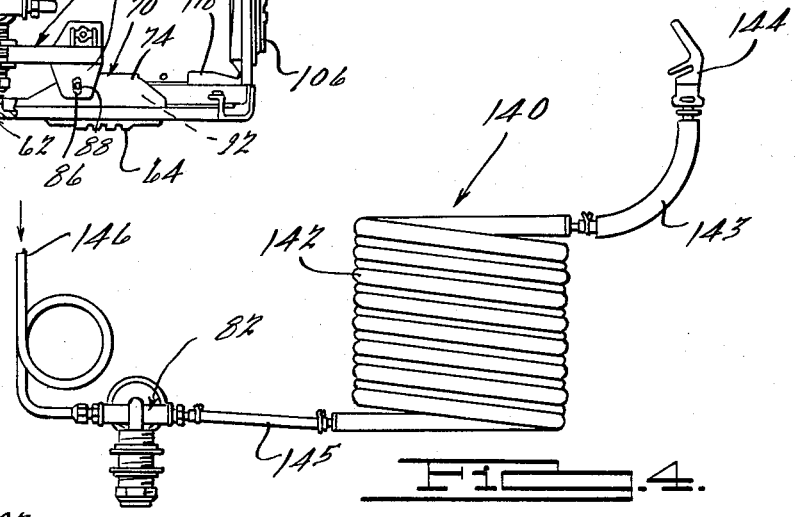
FIG. 4 is a side elevational view of a preferred embodiment of a water cooler mechanism embodied in the present invention.

With reference to FIG. 4, the water circuit for the aforesaid electric type of dispensing apparatus 10 of the present invention comprises the aforementioned push button valve/regulator 82 which is cooperable with a water circuit 140 including a helically coiled conduit 142 which is disposed within the evaporator/chiller assembly 136 and arranged in heat transfer relation with the evaporator section of the refrigeration system 130. The outlet end of the coiled conduit 142 is communicable via a suitable water conduit 143 with a conventional water dispenser or "bubbler" 144 which, as best seen in FIGS. 1 and 2, is mounted upon section 46 of the receptor or basin 40. The inlet end of the coiled conduit 142 is communicable via a suitable water conduit 145 with the valve/regulator 82 which is in turn communicable with a suitable source of potable drinking water via a supply conduit 146. As will be appreciated by those skilled in the art, at such time as the valve/regulator 82 is actuated by means of the actuation of any of the push bars 62, 100 or 102 in the manner hereinafter described, potable water will flow from the source thereof via the conduits 146 and 145 into the coiled conduit 142, where such water will be cooled by operation of the aforementioned refrigeration system 130, which cooled water will thereafter by communicated via the conduit 143 to the bubbler 144 where said water may be conveniently consumed. It is to be noted that the conduit 142 of the evaporator/chiller assembly 146 is normally non-pressurized by virtue of being located downstream from the valve 82, whereby to minimize water spillage that may occasionally occur due to water freezing and rupturing said conduit 142.

In accordance with one of the principles of the present invention, the apparatus 10 may be provided with additional cooling capacity by means of a unique precooler assembly, generally designated by the numeral 150. The assembly 150 comprises inlet-outlet conduits 152, 154, which are serially communicable with a cooling conduit section 158 that is adapted to be secured, as by tack soldering and tin dipping, as seen at 160, to the cooler waste (drain) line representationally designated by the numeral 156. The line 156, of course, connects at the upper end thereof with a drain fitting 158 located in the drain area 56 of the receptor or basin 140, and at the lower end thereof with a suitable drain conduit which functions in a conventional manner to drain waste water to an associated drain system or facility. In a preferred construction of the present invention, the portion of the conduit 158 arranged in heat transfer relation with the line 156 is preferably provided with some type of heat-insulating medium, i.e., insulated tape or the like (not shown), whereby when chilled water travels through the waste line 156, the incoming water being communicated via the conduits 152, 154 and 158 will be precooled by the heat transfer relationship between the conduits 156 and 158. It is contemplated that such precooling will be on the order of 10° to 15° F. so as to provide a material increase in the cooling capacity of the apparatus 10.

For non-electric, i.e., non-refrigerated, variations of the water dispensing apparatus 10 of the present invention, supply water is provided through a suitable supply line to the push button valve/regulator 82 previously described, which is in turn directly connected via a suitable water line to the bubbler 144. That is, for non-electric versions, the water flow circuit would be devoid of the helical conduit 142 associated with the evaporator/chiller assembly 136, as will be appreciated by those skilled in the art.

Figure 5:
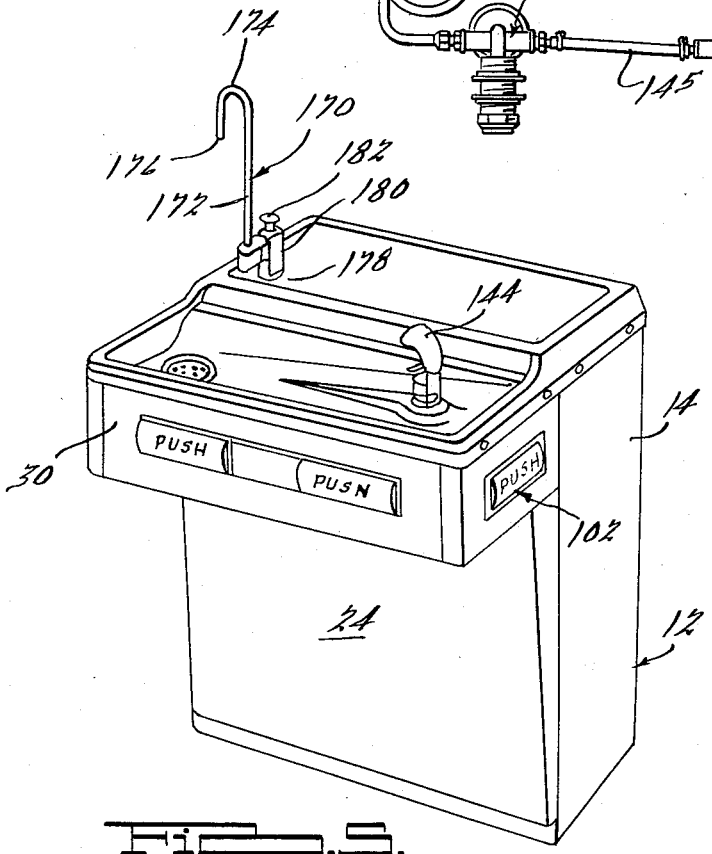
FIG. 5 is an elevated perspective view, similar to FIG. 1, and discloses the present invention as incorporating an optional receptacle filler feature.
Figure 6:
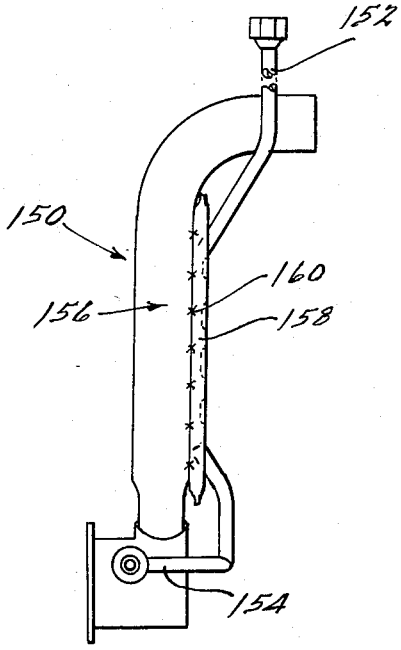
FIG. 6 is a side elevational view of an optional precooling apparatus which may be embodied in the water cooler-fountain of the present invention.

In accordance with another important principle of the present invention, the apparatus 10 may be provided with an optional glass or receptacle filler feature which may be factory-installed or supplied in the form of a retrofit "fit." Such a feature includes a water dispensing spigot 170 normally referred to as a "gooseneck,"

which is adapted to be mounted directly adjacent the receptor or basin 40 in the manner best seen in FIG. 5. The "gooseneck" or spigot 170 includes a generally vertically disposed section 172 which terminates at its upper end in a reverse bend section 174 having an elevated downardly directed discharge end 176. As shown in FIG. 5, the discharge end 176 of the spigot 170 is elevated above the receptor 40 and is oriented laterally opposite the bubbler 144 at a forward portion 178 of the counter top 42. Such an arrangement of the spigot 170 is intended to maximize convenient use for persons with certain types of motion disabilities, as well as the general public, and the elevated orientation thereof is intended to provide for adequate head room for users drinking water from the bubbler 144. Water to be dispensed via the spigot 170 is communicated via a push button-type actuating valve 180 located adjacent the lower end of the spigot 170 so as to provide the additional feature of improved actuating convenience over current state-of-the-art glass filler devices. Such actuating convenience is achieved by virtue of the fact that the actuating button 182 of the valve 180 is intended to accept a vertically downwardly directed force, rather than a force in a horizontal direction required by "push type" gooseneck dispensers in the prior art. Additionally, the push button 182 is located relatively lower than comparable type dispensing apparatus to provide the added convenience for those users who may have to apply pressure by directly leaning on the button 182.

It is to be noted that access to the water dispensing system 60 is intended to be provided by removably mounting the front panel 32 of the forward cabinet portion 30, while access to the refrigeration sysltem 130 for purposes of inspection, repair and the like, is provided by removably mounting the front panel 24 of the rearward cabinet or enclosure portion 14, as previously mentioned. All normal maintenance and repair activities may, therefore, be accomplished without the inconvenience of disconnecting existing plumbing and/or removing the entire dispensing apparatus 10 from its associated support structure, i.e., wall, etc.

It will be seen from the foregoing, and in accordance with an important principle of the present invention, that the cabinet or enclosure 12 is adapted to be cantilever mounted so as to provide ample clearance and convenient access for standard wheelchairs when the bubbler 144 is located in vertical compliance with applicable statutes for the physically impaired, such as A.N.S.I. 117.1-1980 or the applicable A.T.B.C.B. federal guidelines. Moreover, the particular configuration of the apparatus 10 of the present invention enables compliance with correlative blind access statutes and related regulations. An additional feature of the present invention resides in the increased head room and general consumer convenience achieved by the overall shape of the dispensing apparatus 10 and specifically, the water dispensing devices, i.e., bubbler 144 and/or spigot 170 thereof, and that such improved consumer convenience is achieved without any sacrifice in the aesthetically pleasing appearance of the apparatus 10. As will be appreciated by those skilled in the art, such aesthetically pleasing appearance is enhanced by the perception of universal styling which removes the stigma of being offered for use for "handicapped persons only." Another important feature, of course, of the present invention resides in the unique pivoting and sliding mechanism of the front and side push bars which permit actuation of the water system from the forward and either side of the dispensing apparatus 10. The unique interaction between the side push bars 100, 102 and the front or forward push bar 62 also lends itself to convenient O.E.M. or retrofit installation of the side push bars. In addition, the unique glass filler option reduces the potential of interference and head injuries caused by collision with the gooseneck, i.e., spigot 170, while using the bubbler device 144, and the unique glass filler actuating device provides actuating convenience over comparable devices in the art. Finally, the pre-cooler feature of the present invention is intended to provide for an energy efficient cooling system which may be conveniently installed to provide for the economical pre-cooling of water dispensed by the apparatus and therefore supplement the refrigerating operation of electric type coolers.

While it will be apparent that the preferred embodiments as illustrated herein are well calculated to fulfill the objects above stated, it will also be appreciated that the present invention is susceptible to modification, variation and change without departing from the proper scope of the appended claims.

We claim:

1. A barrier-free water cooler in combination in a water dispensing apparatus adapted for operative association with a water source comprising:

a cabinet structure having a first side portion extending laterally between second and third spaced generally parallel side portions;

water dispensing means associated with said apparatus and including valve means for controlling the flow of water from the source thereof to said dispensing means;

mounting bracket disposed within said cabinet structure and having laterally opposed mounting portions;

first actuating means for actuating said valve means comprising first manually engageable push bar presented on said first side portion and means for slidably and pivotally securing said first push bar to each of said laterally opposed mounting portions;

at least one second actuating means for actuating said first actuating means comprising second manually engageable push bar presented on one of said second and third side portions, said second push bar having laterally opposed ends, one of said ends being pivotally secured to said cabinet structure and the other of said ends having an actuating leg extending generally orthogonal to said second push bar;

said first actuating means defining a camming surface and said actuating leg portion being positioned adjacent said camming surface;

whereby selective application of a force to either end of said first push bar means results in actuation of said valve means and whereby selective application of a force to said second push bar means causes said actuating leg portion to slidably engage and move said camming surface to effect actuation of said first push bar means, thereby resulting in actuation of said valve means.

2. The water cooler of claim 1 wherein said first actuating means includes a generally concave portion defining a hollow interior and wherein said camming surface is disposed within said hollow interior.

3. The water cooler of claim 1 wherein said mounting bracket is disposed on said valve means.

4. The water cooler of claim 1 wherein said means for slidably and pivotally securing said first push bar comprises elongated slot and pin construction and wherein said first push bar functions as a lever.

5. The water cooler of claim 1 wherein said first push bar is mounted for movement about a generally vertically extending axis.

6. The water cooler of claim 1 wherein said first push bar is mounted for pivotal movement about a plurality of generally vertically extending axes.

7. The water cooler of claim 1 wherein said first push bar is mounted for pivotal movement at the opposite ends thereof.

8. The water cooler of claim 1 wherein said second push bar is mounted for pivotal movement about a generally vertically extending axis.

* * * * *